United States Patent [19]

Phillips

[11] 4,340,891

[45] Jul. 20, 1982

[54] DUAL POLARIZED BASE STATION RECEIVE ANTENNA

[75] Inventor: James P. Phillips, Lake In The Hills, Ill.

[73] Assignee: Motorola, Inc., Schaumburg, Ill.

[21] Appl. No.: 171,629

[22] Filed: Jul. 23, 1980

Related U.S. Application Data

[63] Continuation of Ser. No. 900,404, Apr. 26, 1978, abandoned.

[51] Int. Cl.[3] ..... H01Q 11/13; H01Q 21/29

[52] U.S. Cl. ..... 343/713; 343/730; 343/803; 343/853

[58] Field of Search ..... 343/725, 726, 727, 728, 343/729, 730, 853, 803

[56] References Cited

U.S. PATENT DOCUMENTS

| | | | |
|---|---|---|---|
| 2,760,192 | 8/1956 | Shanklin | 343/727 |
| 3,041,606 | 6/1962 | Berry et al. | 343/726 |
| 3,213,456 | 10/1965 | Korvin | 343/797 |
| 3,518,692 | 6/1970 | Kuecken | 343/797 |
| 3,555,552 | 1/1971 | Alford | 343/726 |
| 3,718,932 | 2/1973 | Ikrath et al. | 343/728 |

*Primary Examiner*—Eli Lieberman

*Attorney, Agent, or Firm*—James A. Scheer; James W. Gillman

[57] ABSTRACT

A communication system for receiving signals from both relatively low power level portable transmitters and relatively high power mobile transmitters wherein the receiving antenna utilizes selectively gain controlled vertically and horizontally polarized elements for enhancing signals from the portable transmitters and from longer range mobile transmitters while, at the same time, degrading signals from near field mobile transmitters.

4 Claims, 5 Drawing Figures

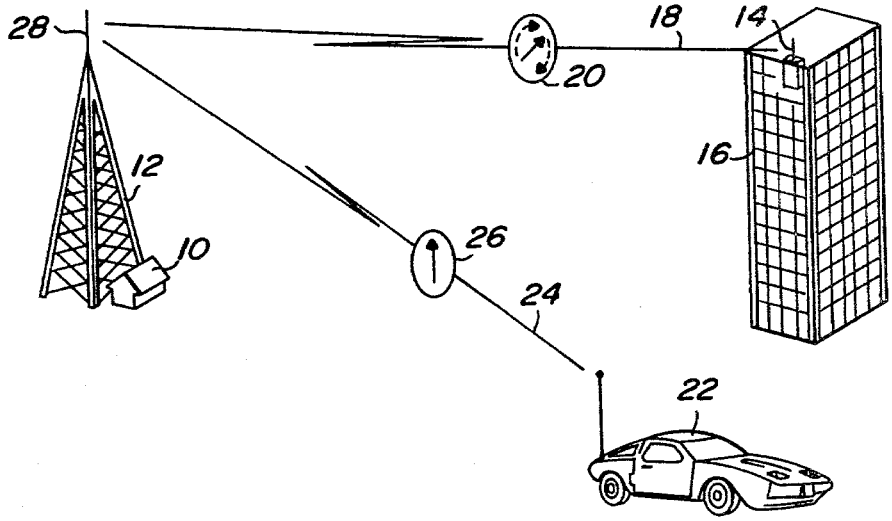
Fig. 1
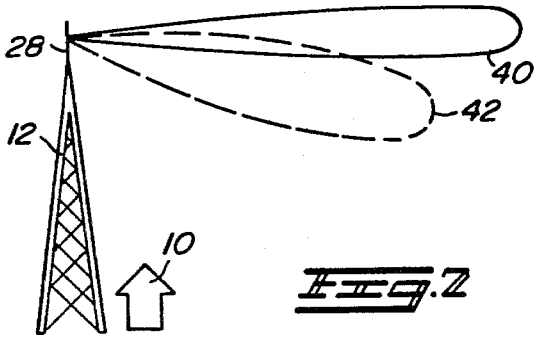
Fig. 2
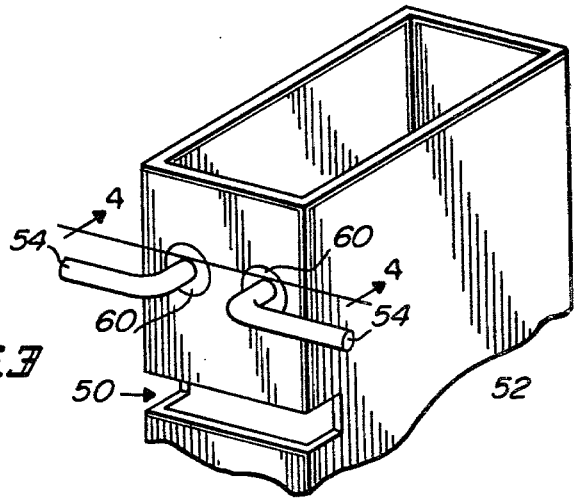
Fig. 3
Fig. 5
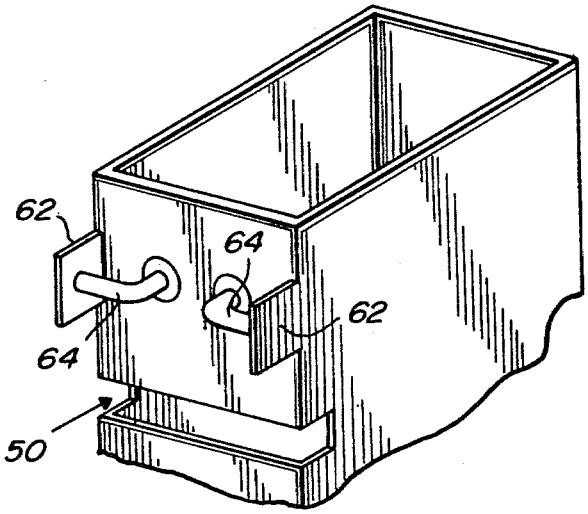
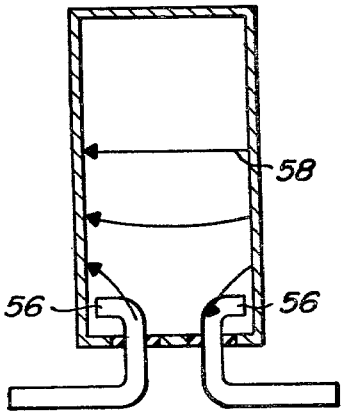
Fig. 4

DUAL POLARIZED BASE STATION RECEIVE ANTENNA

This is a continuation of application Ser. No. 900,404, filed Apr. 26, 1978, now abandoned.

FIELD OF THE INVENTION

The invention relates to a receiving antenna system having both horizontally and vertically polarized elements for selective gain control of different classes of transmitters located at both near and far range.

BACKGROUND OF THE INVENTION

In high elevation community type receiving stations, which are currently in wide use, close in mobile transmitters, operating outside of a predetermined desirable communication frequency may cause undue interference with desired communication transmitters because of intermodulation distortion. While receiver selectivity can compensate for and even obviate this problem in some cases, it is desirable to somehow minimize the very high signal levels from adjacent channels when a nearby mobile transmitter would otherwise come through the selectivity skirt of the receiver.

SUMMARY OF THE INVENTION

Because of the above mentioned and other problems it is advantageous to employ a means of selectivity built into the receiving antenna to minimize intermodulation distortion from a very strong off-frequency signal. The system of the invention takes advantage of the fact that mobile transmitters employ vertically polarized antennas and that nearby mobile transmitters tend to radiate signals which are not rotated in terms of polarization over short, line-of-sight transmission paths while lower power portable transmitters are more likely to be used inside of buildings or other structures and as a result, the polarization characteristic of such a transmitter signal is likely to be random due to reflection of the signals in passing through and out of the structures.

It is therefore an object of the system of the invention to provide a receiving antenna for the community receiver which is polarized both vertically and horizontally for maximizing reception from desirable transmitters and for minimizing reception from undesirable transmitters.

It is another object of the system of the invention to maximize the gain of the receiving antenna for vertically polarized transmitter signals which eminate from longer ranges while minimizing the gain of the antenna for vertically polarized signals transmitted from nearby sources.

It is still another object of the system of the invention to provide for high gain in a horizontally polarized element of the receiving antenna while providing high gain in the horizontal direction of a vertically polarized element and relatively lower gain in lower elevation segments of the vertically polarized element pattern.

These and other objects of the invention will become more readily understood when the detailed description of the invention is read and considered together with the drawings in which:

FIG. 1 illustrates, in a general manner, the environment in which the system of the invention operates, FIG. 2 is illustrative of one embodiment of an antenna pattern utilized in the system of the invention, FIG. 3 is a detailed drawing of one antenna configuration which may be used in the system of the invention, FIG. 4 is a detailed illustration of the dipole element feed configuration of the antenna of FIG. 3, and FIG. 5 is another antenna embodiment which may be used in the system of the invention.

DETAILED DESCRIPTION OF THE INVENTION

Referring to FIG. 1, it will be understood that, advantageously, receiver 10 of the system may be located in high rise structure 12 to best serve community communication requirements. Relatively low power portable transmitter 14 is likely to be located in building or structure 16. Radiation path 18 for portable transmitter 14 is through and out of structure 16 thereby causing a random polarization of the signal therefrom (shown schematically 20). Random polarization 20 is due to the multiple reflections of the energy which are to be expected under the stated condition; i.e., transmission from within a building or structure to a receiver outside of the structure.

On the other hand, mobile unit 22 may utilize a vertical whip antenna which is known to be vertically polarized 26. Since mobile unit 22 is not within a structure such as building 16, line of transmission 24 is more likely to be on a clear or line-of-sight path to receiver antenna 28. Since transmission path 24 is not as likely to include reflective surfaces, the signal is more likely to retain its vertically polarized character all the way to receiving antenna 28. And, of course, it will be recognized that if signal path 24 from relatively high powered mobile transmitter unit 22 does encounter a reflective surface in its path to receiving antenna 28, it is likely that it will be attenuated somewhat in the process.

In practice, a typical ratio between the signal strength of a mobile unit and a portable unit is on the order of 88 dB, with the higher power radiated signal being from the mobile unit. This ratio can be effectively reduced in terms of the input terminals to the receiver by means of the use of an antenna which is tailored to the particular application. In the embodiment of the invention heredescribed, dual polarized receiving antenna 28 is used. That is, antenna 28 has at least one element which is vertically polarized and at least one element which is horizontally polarized. FIG. 2 is representative of the elevation patterns of these elements. Referring to FIG. 2, the vertically polarized element(s) have a relatively narrow vertical pattern 40 which is aimed to peak in an essentially horizontal direction, approximately parallel to the ground. This pattern may be depressed from the horizontal somewhat depending on the maximum expected range of a vertically polarized mobile transmitter antenna. This provides for relatively high gain for reception of vertically polarized signals (from mobile units) located at maximum range. But elevation pattern 40 response degrades rapidly as the angle of the transmission line is depressed from the horizontal (or from the peak response of pattern 40). This means that the antenna response to nearby mobile units is greatly reduced thus effectively reducing radiation energy levels from nearby mobile transmitters at receiver 10 input terminals.

The horizontally polarized elements of antenna 28 are arranged so that elevation pattern 42 of the horizontally polarized elements is somewhat depressed from that of elevation pattern 40 of the vertically polarized elements. This means that randomly polarized signals from nearby portable transmitters are received, at least in part, by a higher gain horizontally polarized antenna. This is helpful to system operation because the expected or useful operating range of portable units is generally short when compared to mobile unit's range. Also to be considered is the fact that a distant portable unit may have enhanced reception by means of the high gain response of the vertically polarized elements of receiving antenna 28 if the operator of such a distantly located portable unit chooses to operate in the open (not from within a structure), maintaining line-of-sight to receiving antenna 28 and orienting the transmitting antenna so that it is vertically polarized. These are reasonable steps which may be taken by the operator of a portable unit in order to effectively increase the transmitting range of his communication system under conditions which would otherwise be marginal or negative.

The receiving antenna system as described, therefor, provides a useful degree of rejection to a nearby off-frequency mobile unit while enhancing response to portable units, whether operated from a nearby position or at longer ranges.

Antenna 28 may take the form shown in FIGS. 3 and 4. Slot 50 in wave guide 52 is vertically polarized and dipole 54 is horizontally polarized. Dipole 54 is mounted in the same narrow face of wave guide 52 as is slot 50. FIG. 4 illustrates a method of feeding dipole 54. Probes 56 are oriented parallel to E plane 58 of wave guide 52. Referring again to FIG. 3, it may be seen that dipole 54 may be mounted by means of feedthrough insulators 60 to provide both mechanical mounting structure and electrical feed thereto. And, as is well known in the art, a multiplicity of such slot and dipole elements may be stacked in array form to control or increase directivity (not shown). Of course, it may be necessary for dipole elements 54 to overhang the width of wave guide 52, thus limiting the proximity of adjacent elements of the antenna array. FIG. 5 illustrates a design which allows adjacent wave guide elements to abut one to the other. End plates 62 are provided to load and fold dipole elements 64. This allows the total width of dipole elements 64 and 62 to be shortened to be no more than the width of wave guide 52.

Various other modifications and changes may be made to the present invention which are derived from the principles of the invention as described herein without departing from the spirit and scope thereof, as encompassed in the accompanying claims.

What is claimed is:

1. In a communication system including undesirable off-frequency transmissions from relatively high power output mobile transmitter antennas and desirable on-frequency signal transmissions from relatively low power output portable transmitter antennas wherein the undesirable transmissions arrive at a base station receiver antenna system substantially vertically polarized and the desirable transmissions arrive at the base station receiver antenna system substantially cross polarized, the method comprising the steps of:

providing the receiver antenna system with a dipole means having relatively high gain response to horizontally polarized signals combined in a unitary structure with a slot means for providing relatively low gain response to vertically polarized signals to receive and combine the desirable and undesirable transmissions, and to provide a degree of isolation between the desirable and undesirable transmissions; and coupling the receiver antenna system to a base station receiver such that the received desirable and undesirable transmissions are simultaneously coupled to the base station receiver.

2. An improvement in a communication system having at least one mobile transmitter operating on a predetermined channel with a relatively high power input to a vertically polarized antenna, at least one portable transmitter on an adjacent channel with a relatively low power input to a randomly polarized antenna, and a common base station including a receiver and a receiver antenna system for receiving and combining transmissions on both the predetermined channel and the adjacent channel, the improvement comprising:

said receiver antenna system having both a dipole means with a horizontally polarized gain response pattern combined in a unitary structure with a slot means having a vertically polarized gain response pattern, and receiver antenna system having a relatively high gain response in said horizontally polarized pattern and having a relatively low gain response in said vertically polarized pattern to provide improved isolation between channels;

means for simultaneously coupling received transmissions on the predetermined channel and the adjacent channels to the base station receiver.

3. The communication system according to claim 1 or 2 wherein said dipole means is a folded dipole.

4. The communication system according to claim 3 wherein said folded dipole is end loaded.

* * * * *